United States Patent [19]

Suzuki et al.

[11] 4,428,691

[45] Jan. 31, 1984

[54] DOT MATRIX PRINTER HEAD

[75] Inventors: Osamu Suzuki; Keiji Nakamura, both of Tokyo, Japan

[73] Assignee: Nippon Electric Co., Ltd., Tokyo, Japan

[21] Appl. No.: 298,410

[22] Filed: Sep. 1, 1981

[30] Foreign Application Priority Data

Sep. 11, 1980 [JP] Japan ..... 55-126248

[51] Int. Cl.[3] ..... B41J 3/12

[52] U.S. Cl. ..... 400/124; 101/93.05

[58] Field of Search ..... 101/93.05; 400/124

[56] References Cited

U.S. PATENT DOCUMENTS

| | | | |
|---|---|---|---|
| 3,770,092 | 11/1973 | Grim | 400/124 |
| 4,156,960 | 6/1979 | Ikeda | 400/124 |
| 4,225,250 | 9/1980 | Wagner et al. | 101/93.05 X |
| 4,273,039 | 6/1981 | Luo et al. | 101/93.05 X |

*Primary Examiner*—Paul T. Sewell

*Attorney, Agent, or Firm*—Sughrue, Mion, Zinn, Macpeak & Seas

[57] ABSTRACT

Arranged in the bottom of a cup-shaped cylindrical casing is a solid disc form of axially uniformly magnetized permanent magnet having a single pair of poles each formed on one or the other of its opposite end faces over the whole region thereof. A circular plate of magnetically permeable material is fixedly mounted on the magnet and to which plate a set of coiled posts are fixedly fitted. The casing is preferably formed on its outer periphery with cooling fins for dissipation of heat generated therein during printing operation. The magnet and the plate thereon, identical in outer diameter, are radially spaced an appropriate slight distance from the inner wall surface of the casing to form a bypass circuit for the flux of the magnet. Arranged in the open top of the casing is a spring-charge type print hammer assembly which includes a radial array of resilient tongues (hammers) and print wires secured thereto preferably through the medium of flat armature plates fixed to the respective tongues. The print head is particularly suited for high-speed printing operation with low power requirements and, owing primarily to the extremely simplified form of magnet used, is of reduced fabrication cost. The armature plates, in cooperation with a yoke plate slotted to receive the plates serve to compensate for any possible increase in reluctance of the main magnetic circuit and increase the kinetic energy of the tongues or print hammers when released.

1 Claim, 4 Drawing Figures

DOT MATRIX PRINTER HEAD

BACKGROUND OF THE INVENTION

1. Field of the Invwention

This invention relates to dot matrix printers and more particularly to print heads for use in serial dot matrix printers.

2. Description of the Prior Art

Many types of dot matrix printers are now in use as an output device for data processers or similar apparatuses. Among others, serial type dot matrix printers which are capable of imprinting characters and signs of all sorts and suited for high-speed printing operation have been widely used. As is well known, a serial dot matrix printer includes a print head that comprises print hammers each having a thin, elongate print wire fixed to its tip and drive mechanisms therefor and is arranged to imprint characters (or signs) on a piece of paper each in the form of a set of dots by pressing the print wires against an ink ribbon that faces the piece of paper while moving in a predetermined direction relative to the piece of paper. In such a dot matrix printer print head, the print wires, usually seven or nine, are arranged to converge toward each other. A set of hammer drive mechanisms which include permanent magnets and soleniods required for their operation, are used to actuate the print wires, and the drive mechanisms require a considerably large volume of space compared with that required for the set of print hammers. It follows therefore that, in order to increase the speed of operation of such dot matrix printer print head, the hammer drive mechanisms should be made as compact and lightweight as possible. Alternatively, the power supply for the hammer drive mechanisms can be increased.

In Japanese published unexamined patent application No. 51,569/1980 (corresponding U.S. Pat. No. 4,225,250), there is disclosed a serial dot matrix printer print head of a cylindrical sandwich structure adapted for high-speed operation with reduced size and weight and which includes component members, such as a base plate, a ring form of permanent magnet, a print hammer disc and a yoke plate, laid one on another and clamped together as by bolt means, and also a plurality of electromagnetic drivers (each including a core post and an exciting coil mounted thereon) arranged inside the ring magnet circumferentially at regular intervals to actuate the respective print hammers. Such a print head structure, however, is limited in its speed of operation with low power requirements and its productivity cannot be significantly improved to any desired extent. Specifically, with the above-described structure, in order to release any of the print hammers for dot printing operation, which are normally cocked or held attracted on the respective posts under the effect of a flux of a ring magnet, an exciting coil mounted on the associated post must be fed with an electrical pulse signal of a magnitude large enough to produce a neutralizing flux effective to cancel the flux of the magnet flowing in the same flux channel. In addition, since the electromagnetic drive members, each forming a heat source during printing operation, are surrounded by the ring magnet, efficient heat dissipation cannot be expected and a definite limitation is placed on the operation speed of the print head. On the other hand, formation of cooling fins on the ring magnet result in reduction in the productivity of the print head because the machinability of the magnet material is very limited. Further, formation in the ring magnet of a plurality of bolt-receiving apertures, required to clamp together the print head members into a cylindrical sandwich structure, and segmental magnetization of the ring magnet, designed to partly magnetize the core posts and print hammers to maintain the magnitude of the neutralizing field required at a low level, both complicate the process of fabricating such magnet and impair the productivity of the print head structure. Moreover, in the print head structure, the magnet used as a bias means to normally hold the print hammers in their cocked position forms an outer casing wall of the print head and, accordingly, tends to attract any magnetic substances lying thereabouts. These magnetic substances create a danger of the printing operation being impaired.

SUMMARY OF THE INVENTION

Accordingly, the present invention has for its primary object the provision of a print head for a serial dot matrix printer which is of a novel and unique structure having a main and a bypass magnetic circuit provided for print hammer actuation and is capable of effecting high-speed printing operation with reduced power requirements therefor.

Another object of the present invention is to provide a dot matrix printer print head of the character described which is so designed that heat produced by the exciting coils in printing operation can readily dissipate, so that the generated heat does not limit the speed of the printing operation.

A further object of the present invention is to provide a dot matrix printer print head of the character described which includes a cup-shaped or bottomed cylindrical casing and a permanent magnet in the form of a solid uniformly magnetized disc disposed in the casing to normally hold the print hammers in cocked position. The disc does not require bolt receiving apertures such as those previously needed for clamping assembling and is thus particularly high in productivity, compact in size and lightweight.

According to the present invention, there is provided a dot matrix printer print head which is basically of the structure characterized in that it comprises: a disc-like magnet axially uniformly magnetized to form opposite poles, "N" and "S," on the respective end faces thereof; a circular plate of magnetically permeable material secured to one of the end faces of the disc-like magnet; a plurality of magnetically permeable posts secured upright to the circular plate in circumferentially spaced relation to each other and each having an exciting coil mounted thereon; a cup-shaped cylindrical casing of magnetically permeable material accommodating the disc-like magnet and the circular plate with the posts secured thereto with the other end face of the magnet secured to the inner bottom wall surface of the cylindrical casing; and a print hammer assembly secured to the open top end of the cylindrical casing and including a plurality of radially arranged resilient tongues (hammers) normally held attracted on the respective tips (pole ends) of the posts under the effect of the flux of the disc-like magnet when the exciting coils are non-energized and thin, elongate print wires corresponding in number to the number of resilient tongues and each mounted directly or indirectly on one of the resilient tongues; the disc-like magnet and the circular plate being both arranged in the cylindrical casing with their peripheral edge surfaces radially spaced a predetermined distance from the inner peripheral wall surface of the cylindrical casing to form a bypass magnetic circuit for passage therethrough of part of the flux of the disc-like magnet.

In the present invention, it is desirable that the disc-like magnet be magnetized so as to have a single pole, "N" or "S", formed on each of its opposite end faces uniformly over the whole region thereof and that the magnetically permeable posts with exciting coils mounted thereon be fixedly fitted at one end in respective apertures formed in the circular plate at properly spaced points on a circle or ellipse by screw-threading or swaging means. It is also desirable that the disc-like magnet and the circular plate fitted with the posts or column-like cores be secured to the flat inner bottom surface of the cup-shaped casing by adhesive means with the disc-like magnet interposed between the circular plate and the casing bottom, the casing being formed on its outer peripheral surface with cooling fins.

According to a further feature of the present invention, the print hammer assembly consists of a plurality of resilient tongues (hammers) formed integral with each other from a single disc of resilient material by cutting radial slits therein that extend radially outwardly from the center of the disc coverage, and armature pieces of flat plate form each fitted with a print wire and secured to one of the resilient tongues. Secured to the print hammer disc is a disc-like yoke plate having formed therein a central aperture and slots extending radially outwardly to receive therein the respective armature pieces as secured to the resilient tongues. With such formation of the print hammer assembly, it will be recognized that not only any undesired increase in reluctance of the main magnetic circuit can be readily compensated for but also the resilient tongues designed to impart a mechanical force of printing impact to the associated print wire can have a substantially increased amount of kinetic energy when released owing to the relatively large thickness of the armature pieces secured to the respective resilient tongues.

BRIEF DESCRIPTION OF THE DRAWINGS

The above and other objects, features and advantages of the present invention will become apparent from the following detailed description when taken in conjunction with the accompanying drawings, in which.

DESCRIPTION OF THE PREFERRED EMBODIMENT

Figure 1:
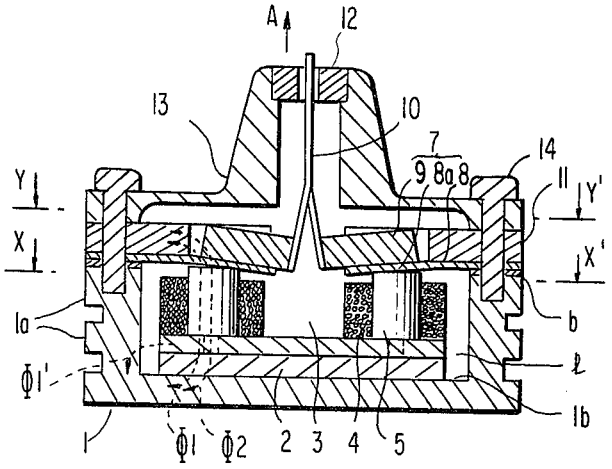
FIG. 1 is an axial cross-sectional view of a preferred form of dot matrix printer print head embodying the principles of the present invention.
Figure 3:
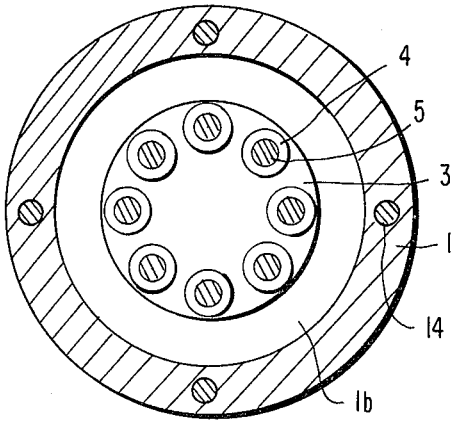
FIG. 3 is a cross-sectional view taken along the line X—X' in FIG. 1.
Figure 4:
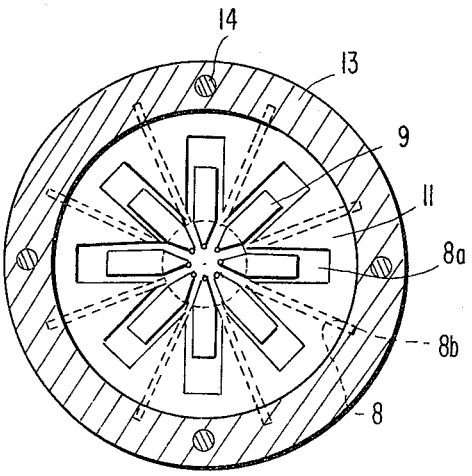
FIG. 4 is a cross-sectional view taken along the line Y—Y' in FIG. 1.

In FIGS. 1 to 4, there is illustrated a preferred form of serial dot matrix printer print head embodying the present invention which is in essence a cylindrical sandwich structure, including a cup-shaped or bottom cylindrical casing 1 formed of an appropriate magnetically permeable material such as a sulfer-free machined steel and formed on its outer peripheral wall surface with cooling fins 1*a*. Firmly secured to the inside surface of the flat bottom wall 1*b* of the cylindrical casing 1 by a bonding adhesion such as a highly heat-resistant epoxy resin is a solid disc form of permanent magnet 2 which acts upon a print hammer assembly, which will be described later in detail, to normally hold the print hammers in cocked position. The magnet 2 is located with its peripheral edge surface radially spaced a predetermined distance l from the inner wall surface of the cylindrical casing 1. Further, the magnet 2, preferably a rare-earth magnet, is magnetized axially or in the direction of its thickness and have a pair of poles, "N" and "S," each formed on one of its opposite end faces uniformly over the whole region thereof. If will be readily understood that such disc-like magnet 2 can be manufactured with particular ease. Adhesively secured to that end face of the disc-like magnet 2 which is remote from the bottom wall 1*b* of the casing 1 is a magnetically permeable flat circular plate 3 formed, for example, of an appropriate rolled steel sheet and finished to an outer diameter substantially equal to that of the disc-like magnet 2. A plurality of apertures 3*a* are located in the peripheral region of the magnetic plate 3 circumferentially at regular intervals. Reference numeral 5 indicates a plurality of parallel column-like cores or posts formed of a readily upsettable, magnetically highly permeable material such as a silicon steel, and each is fitted at one end into the respective aperture 3*a* in the magnetic plate 3 to extend upright therefrom and fixed thereto as by swaging or upsetting.

Figure 2:
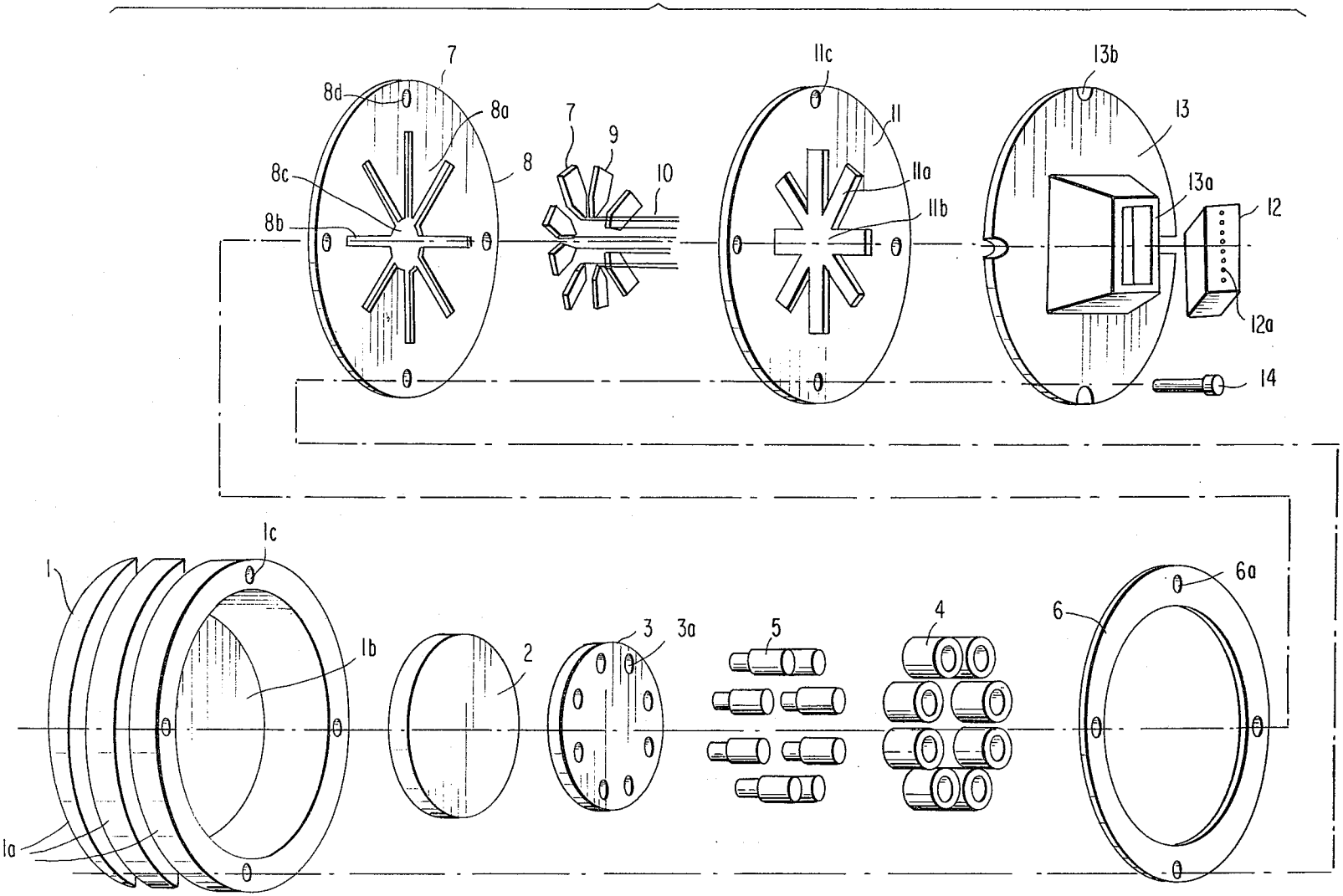
FIG. 2 is an exploded pictorial view of the print head shown in FIG. 1.

On top of the cup-shaped casing 1 is arranged a print hammer assembly 7 with an annular spacer 6 being interposed therebetween. The print hammer assembly 7 comprises: a disc of resilient magnetically permeable sheet material having a plurality of substentially triangular-shaped tongues 8*a*, eight in number, defined in the disc 8 by a central opening 8*c* and slits 8*b* extending radially outwardly therefrom; a plurality of armature pieces 9, of flat plate form, corresponding in number to the resilient tongues 8*a* and each secured to one of the latter; and thin, elongated print wires 10 each fixed at one end to the tip end of one of the armature pieces 9 as by welding. Arranged also on the resilient disc 8 of the print hammer assembly 7 is a circular form of yoke plate 11 formed therein with a central opening 11*b* and slots 11*a* extending radially outwardly therefrom and in which slots the armature pieces 9 fixed to the respective resilient tongues 8*a* are freely received. Accordingly the print wires 10, eight in number, fixed to the tip end of the respective armature pieces 9 in circumferentially spaced relation, are located within the central opening 11*b* in the yoke plate 11. Arranged on the yoke plate 11 is a wire guide frame 13 which serves to direct the free ends of print wires 10, fixed to the respective armature pieces 9, into a wire guide 12 which is fixedly fitted in an outward projection 13*a* formed on the wire guide frame 13. The wire guide 12 is formed of ruby and has a plurality of through apertures 12*a* formed therein to slidably receive the respective print wires 10 so that the free ends of the latter are placed in a predetermined array, for example, in a single straight row. The wire guide frame 13 is preferably formed of a light metal such as aluminum, a plastic or the like material. The print head members laid one on another in the manner described above, including casing 1, spacer 6, print hammer dise 8, yoke plate 11 and wire guide frame 13, are each formed, as shown in FIG. 2, with four equally spaced threaded apertures 1*c*, four through apertures 6*a*, 8*a* or 11*c* or notches 13*b* and are firmly joined together by a set of four clamp bolts 14 fitted therethrough.

As will readily be observed, the print head constructed and arranged as described hereinabove is particulary compact and lightweight because of its cylindrical sandwich structure, in which the print hammer assembly 7 is firmly held in place, by clamp bolt means 14, on top of the cup-shaped cylindrical casing 1 of a readily machinable, magnetically permeable material, in which the hammer actuating members including permanent magnet 2, circular plate 3, posts 5 and exciting coils 4 are accommodated. Further, the print head is highly improved in productivity owing to the fact that the permanent magnet 2, of hard machinable material, is shaped as a solid disc and firmly secured to the bottom wall 1*b* of the cylindrical casing 1, the cores or posts 5 with exciting coils 4 mounted thereon being fixedly mounted on the magnetic plate 3, of disc form, which is laid on the permanent magnet 2.

Description will next be made of the operation of the print head of the present invention, which is of the so-called spring-charge type.

Referring to FIG. 1, in the print head illustrated therein, the resilient tongues or hammer arms 8*a* of the print hammer assembly 7 are normally cocked or held attracted on the pole ends of the respective posts 5 under the effect of the flux Φ1 of permanent magnet 2. In printing operation, when any one of exciting coils 4 is energized to produce a neutralizing flux Φ2 directed to counteract the flux Φ1 of permanent magnet 2, the resilient tongue 8*a* previously held attracted on the pole end of the associated post 5 is released to swing away therefrom and the associated print wire 10 is driven longitudinally in the direction of the arrow A to produce on a piece of paper (not shown) a dot element of the character desired.

As observed, in the embodiment illustrated, the magnetic plate 3, on which core posts 5 are arranged with exciting coils 4 mounted thereon, and the permanent magnet 2, both accommodated in the bottom of cylindrical casing 1, are radially spaced a slight distance l from the inner peripheral wall surface of the casing 1 to define an annular air gap in cooperation therewith whereby a bypass magnetic circuit is provided for the flux of the permanent magnet 2 which allows at least a portion of the flux to flow across the annular air gap l from the outer peripheral edge surface of the magnetic plate 3. With this arrangement, upon energization of any one of the exciting coils 4, as the amount of flux Φ2 produced by the exciting coil 4 in a direction to counteract the main flux Φ1 of the permanent magnet 2 increases, the leak flux Φ1′ or that portion of the flux Φ1 leaking into the bypass magnetic circuit from the outer peripheral edge of magnetic plate 3 gradually increases in amount while at the same time the amount of main flux Φ1 of permanent magnet 2 passing through the pole end of the associated post 5, on which a resilient tongue 8*a* is normally held attracted, is reduced. And, when the magnitude of coil flux Φ2 comes close to its maximum, the main flux Φ1, which has been slowly decreasing in amount, comes to be suddenly cancelled. To be more specific, that portion of the flux of the permanent magnet 2 which is assigned to each of the resilient tongues 8*a* and, in the inoperative state of the resilient tongue with no drive current fed to the associated exciting coil 4, is effective to hold the resilient tongue 8*a* attracted on the pole end of the associated post 5, consists of a main flux portion Φ1 flowing through the print hammer assembly 7 and a leak flux portion Φ1′ flowing through the bypass magnetic circuit from the outer peripheral edge surface of magnetic plate 3 to the adjacent inner wall surface of the cylindrical casing 1; and in this state the main flux portion Φ1 is extremely large in magnitude compared with the leak flux portion Φ1′. On the other hand, in operation of the print head, when an exciting coil 4 is energized, the drive current fed thereto reaches its steady level of magnitude only after a short transient period and accordingly the coil flux Φ2 is gradually increased to reach its maximum. In this process, while the flow of main flux Φ1 is obstructed by the coil flux Φ2 to decrease with increase of the latter, the leak flux Φ1′ flowing through the bypass magnetic curcuit continues gradually to increase as it is combined with that portion of main flux Φ1 which is increasingly obstructed by the coil flux Φ2; and, when the coil flux Φ2 comes close to its maximum, the main flux Φ1 is sharply further reduced and thereafter only the flow of leak flux Φ1′ through the bypass magnet circuit is allowed. It will be noted, therefore, that the resilient tongue 8*a* can be released instantaneously from the associated post 5 upon energization of the exciting ciol 4 without any increase in driving power as required to produce a neutralizing flux of an intensity high enough to cancel the main flux Φ1 of magnet 2 in an instantaneous fashion. As will readily be understood, such high responsiveness of the resilient tongues or hammers enables use of drive signal pulses of reduced time width and interval and hence high-speed printing operation with lower driving power requirements. Upon interruption of the current energizing the exciting coil 4, the coil flux Φ2 directed to counteract the main flux Φ1 vanishes, allowing the latter to start to flow through the print hammer assembly 7 along the main magnetic circuit, limited in reluctance compared with the bypass magnetic circuit, and the leak flux Φ1′ is reduced to a minimum. As the result, the associated resilient tongue 8*a* is restored to its normal, cocked position held attracted on the pole end of the adjacent post 5.

In the print head of the present invention, which operates upon the basis of flux cancellation, as described above, it is required that the radial gap distance l between the inner wall surface of the cylindrical casing 1 and the peripheral edge surface of magnetic plate 3 be properly determined to form a bypass magnetic circuit for the flux of the permanent magnet 2. In determining the magnitude of gap distance l, various factors should be taken into account, including the dimensions and materials of circuit components and the strength of the permanent magnet 2. In this connection, an important consideration is to properly adjust the permeability of the main and bypass magnetic circuits, which depends upon the air gap between the pole end face of each of posts 5 and the associated resilient tongue 8*a* in its neutral position and upon the radial gap distance l, respectively. For example, in the embodiment described, the cylindrical casing 1 has an outer diameter of 44 mm., an inner diameter of 34 mm., and a height of 15.4 mm. measured from the inner surface of bottom wall 1*b* to the open-top end face of the casing. The disc-like magnet 2, mounted in the casing on its bottom wall 1*b*, is of 26 mm. diameter and 3.5 mm. thickness. The magnetic plate 3, mounted on that surface of magnet 2 which is remote from the casing bottom, is of 26 mm. diameter and 1.5 mm. thickness. With the dimensions so specified, obviously an air gap of a distance l=4 mm. is included in the bypass magnetic circuit. In this connection, it is to be noted that, if the gap distance be set at l=0, the main flux Φ1 of the permanent magnet 2, now short-circuited, would be unable to reach a level required to attract the resilient tongue 8*a* onto the pole end of the associated post 5.

Further, in the print head described above, it will be readily appreciated that heat generated by exciting coils during printing operation can readily dissipate owing to the provision of cooling fins 1*a* on the outer wall surface of the cylindrical casing 1, in which the exciting coils are accommodated, and involves no special limitations on the printing speed.

While one preferred embodiment of the present invention has been shown and described herein, if will be apparent to those skilled in the art that various changes and modifications may be made without departing from the spirit or scope of the invention as defined in the appended claims. For example, in the embodiment illustrated, the magnetic plate and the disc-like magnet may both be formed with a central aperture, if desired, to enable the lead wires of the exciting coils to be directed therethrough. Further, the annular space between the inner wall surface of the cylindrical casing and the peripheral edge surfaces of the magnetic plate and the disc-like magnet may be filled with a suitable insulating element with a view to facilitating the positioning of the two disc members and the proper setting of the permeability of the bypass magnetic circuit. Also, in the embodiment illustrated, the annular spacer 6 is a shim employed between the resilient disc of the print hemmer assembly and the top end of the cylindrical casing for fine adjustment of the air gap between the pole end of the posts and the respective resilient tongues in neutral position and may be formed of either a magnetically permeable or an insulating material. Use of such spacer is not required where the gap setting is obtainable by adjusting the height of the casing. It is to recognized, however, that the permeability of both the main and bypass magnetic circuits can conveniently be adjusted by varying the number of such spacers employed.

What is claimed is:

1. A print head for a dot matrix printer comprising:

a cup-shaped cylindrical casing means (1) having a flat circular bottom wall (16) and a cylindrical side wall (1*a*) made of magnetically permeable material;

a disc-shaped permanent magnet (2) having a diameter smaller than an inner diameter of said bottom wall, said magnet being axially magnetized and mounted coaxially on said bottom wall and being surrounded by said side wall;

a disc-shaped plate (3) having a diameter substantially equal to said permanent magnet and forming an annular gap between itself and said cylindrical side wall, said plate being made of magnetically permeable material and allowing a leakage of a portion of a magnetic flux from said magnet through said air gap into said side wall;

a plurality of electromagnetic elements (5) mounted perpendicularly on the surface of said plate, said electromagnetic elements being circumferentially spaced from one another and each being made of a post of magnetically permeable material;

a coil (4) wound on each of said electromagnetic elements; and a plurality of hammers (7, 8, 8*a*, 9, 10) equal in number to said electromagnetic elements, said hammers having a disc (8) fixed to an open end of said cylindrical side wall and formed of a resilient magnetically permeable material and a plurality of tongues (8*a*) extending inwardly from said disc so that each of said tongues overlies each electromagnetic element to form one of said hammers and a magnetic flux path between said magnet and its associated electromagnetic element, said tongues being attracted on the tips of said respective posts under the influence of said magnetic flux so long as said coils remain unenergized, said hammers further having a plurality of print wires (10) respectively secured onto tips of said tongues.

* * * * *